US006244007B1

(12) United States Patent
Heikkila

(10) Patent No.: US 6,244,007 B1
(45) Date of Patent: Jun. 12, 2001

(54) ROOF WITH EXPOSED OPENINGS

(76) Inventor: Unto A. Heikkila, Herdia 3000-2199, Heredia (CR), 2199

( * ) Notice: Subject to any disclaimer, the term of this patent is extended or adjusted under 35 U.S.C. 154(b) by 0 days.

(21) Appl. No.: 09/561,913

(22) Filed: May 1, 2000

(51) Int. Cl.[7] ..... E04B 1/70

(52) U.S. Cl. ..... 52/302.3; 52/783.14; 52/798.1; 52/533; 52/537

(58) Field of Search ..... 52/14, 302.1, 302.3, 52/302.4, 302.9, 630, 674, 783.1, 783.11, 783.14, 783.15, 783.16, 798.1, 799.1, 799.11, 518, 519, 522, 533, 537, 536, 534

(56) References Cited

U.S. PATENT DOCUMENTS 722,918 * 3/1903 Skeele ..... 52/537 X
3,310,925 * 3/1967 Le Brun ..... 52/537
3,412,517 * 11/1968 Ellis et al. ..... 52/533 X
3,660,955 * 5/1972 Simon ..... 52/537 X
3,852,933 * 12/1974 Guzzo ..... 52/537 X
4,373,315 * 2/1983 Farrant ..... 52/522
4,404,784 * 9/1983 Gorman et al. ..... 52/534
4,580,384 * 4/1986 Hutcheson ..... 52/537
4,819,398 * 4/1989 Dameron ..... 52/537 X
5,473,847 * 12/1995 Crookston ..... 52/302.1
5,765,329 * 6/1998 Huang ..... 52/302.3

* cited by examiner

*Primary Examiner*—Richard Chilcot
(74) *Attorney, Agent, or Firm*—A. David Pellinen

(57) ABSTRACT

A roof has a series of panels are positioned along roof joists such that there are upper and power panels to provide a series of air paths between the upper and associated lower panel. The upper panels are shorter in length than the lower panels so that a portion of the lower panel is exposed to create an opening for air to exit. The combination of the air paths and the exposed panels permits the free flow of air from the bottom to the top of the roof which allows cooling as well as rain water to flow along the lower panels.

5 Claims, 2 Drawing Sheets

ROOF WITH EXPOSED OPENINGS

BACKGROUND OF THE INVENTION

The outward exposure of roofs causes great amounts of heat to be developed at the roof and the underlying structure. To dissipate this heat ventilated roofing systems are well known. A roof cover may have a panel or series of panels overlying another panel or roof so that a space is created between the two. The upwardly sloping passageway formed between the two permits the upward circulation of air thus having a cooling effect. However, the cooling effect is minimized by barriers impeding the free flow of air.

In addition where there is a roof underneath an upper roof panel it is not intended to carry rain water. Where air is permitted to flow upwardly there is a venting arrangement which prevents water flow. U.S. Pat. No. 5,473,847 to Crookston is illustrative of a ventilated roofing system. The vent of Crookston permits air to flow but a shield excludes any moisture or rain from the lower roof panel. None of the openings are exposed to the ambient. It would be desirable to provide a roof with a more efficient cooling system.

SUMMARY OF THE INVENTION

The present invention vents a roof but departs from the prior art by permitting condensation to form and flow down a lower roof panel and providing for the flow of rain water. For ease of explanation an upper roof panel will be termed a sun shield and the lower roof panel a water roof. These terms help explain their respective functions in that the sun shield acts to shield the lower panel against the direct influence of the sun. The water roof functions to permit condensate water as well as rain water to flow downwardly along the water roof. The sun shield overlays the majority of the water roof area except for a portion at the top of the water roof so that the water roof is open and exposed to the elements at the top or apex of the roof. By contrast when a lower roof panel in the prior art is provided it is not open at the apex but is shielded from the elements at the apex.

As the sun warms the sun shield it shields the water roof with the result that there is a temperature differential between the two, with the exception, of course, at the upper exposed portion of the lower panel. This temperature differential is significant enough to cause a flow of air from the bottom of the roof to the top of the roof and exits at the opening.

According to the invention a series of panels are placed on a roof, each panel having two portions, a longer portion and a shorter portion. A succeeding panel's upper and shorter portion is placed over the preceding panel's longer portion, the process being repeated until the roof is completely covered. The first and last panels will have only one portion, such as a shorter panel for one and a longer panel for the other. As the upper panel is shorter than the lower panel the resulting gap provides an opening for air to exit. The series of panels may be made of metal, steel or any suitable material known in the art.

DETAILED DESCRIPTION OF THE INVENTION

Figure 1:
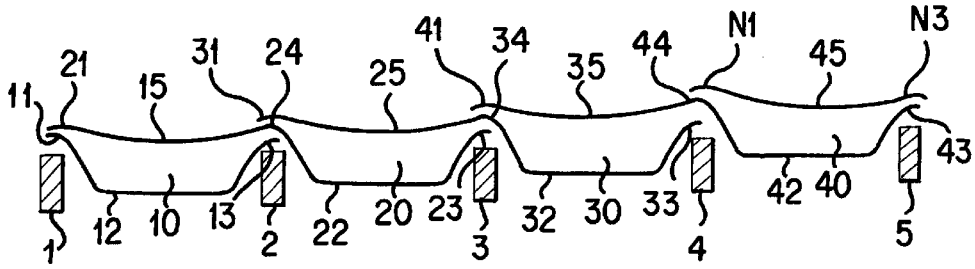
FIG. 1 shows an end view of the roof panels of the invention.

FIG. 1 is an end view of the inventive roof. Numerals 1–5 represent a series of succeeding roof joists to which a series of roof panels are nailed or fastened. A first panel extends from the first joist to the second joist. The first panel with ends 11, 13 is placed on the first two joists 1 and 2 such that the left end 11 is over joist 1 and right end 13 is over the succeeding joist 2. There is an intermediate portion 12 lower than ends 11 and 13.

A second panel extends from the first joist 1 to the third joist 3. The second panel with ends 21, 23 is placed with left end 21 of the second panel over the left end 11 of the first panel and thus over joist 1, and the right end 23 placed on a third joist 3. A portion 22 of the second panel is over the right end 13 of the first panel and thus also over joist 2, so that a portion of the second roof panel overlays not only the second joist but also the first roof panel.

A third panel extends from the second joist 2 to the fourth joist 4. The third panel with ends 31, 33 is placed with left end 31 over portion 24 and thus over end 13 and joist 2, and the right end 33 is placed over the fourth joist 4. A portion 34 of the third panel overlays the end 23 of the second panel and thus joist 3.

A fourth panel, in FIG. 1 the penultimate panel, extends from the third joist 3 to the fifth joist S. The fourth panel with ends 41, 43 has the left end 41 over portion 34 and thus over end 23 and joist 3, and the right end 43 over joist 5. A portion 44 is over end 33 and thus joist 4, the next to the last or penultimate joist in FIG. 1.

This arrangement of panels is extended until the roof is covered. The fifth panel, and in FIG. 1 the last and final panel, extends from the fourth joist to the fifth joist. The final panel is designated as the Nth panel, with ends N1, N3. As shown in FIG. 1 the Nth panel has end N1 over portion 44 and thus over end 33 and joist 4, and end N3 will be over end 43 and thus over the last joist 5.

There will always be between joists a sun shield and a water roof as these terms have been defined. For example, between joists 3 and 4 there is a sun shield 35 and a water roof 32. Note that on the sides of the joists the lower panels curve slightly as they extend or depend from the top of the joists on one or the other side of the joists. No limitation is intended by the curve as illustrated as there are a variety of curvatures that may be employed. One advantage of the invention is that when a panel curves or is close to the joist it may be nailed or fastened into the joist from the sides as well as from the top. The tops of the panels also have a slight curvature the degree to which they curve being a matter of design and aesthetics. The panels may have a slight curvature such as between 21 and 24. The upper panels may be nailed or otherwise fastened from the top.

It will be seen that the upper and lower portions give rise to spaces 10, 20, 30 and 40. Because the roof is slanted a flow of air will pass along the spaces 10, 20, 30 and 40 from the entry way to exit at the top opening as a result of warm air rising. Not only are there are no barriers to the flow of air as the top of the roof is opened to the ambient but rain water will be permitted to run down the water roof. The resulting passage of air has a general cooling effect on the roof. Portions 15, 25, 35 and 45 overlay the lower portions 12, 22, 32 and 42 to give rise to spaces 10, 20, 30 and 40.

In FIG. 1 each of the roof panels has two portions, a lower and an upper portion. Of course the same result can be obtained by having separate panels for the upper and lower portions. Referring to Fig.1 the second, third and fourth roof panels can each consist of separate panels. Thus a panel may extend only from joist 1 to joist 2 overlying the first panel. Two separate panels may extend only from joist 2 to joist 3; one lower than the other. Further panels extend this concept to the last joist. The arrangement of Fig.1 is preferable because it is easier to install and is stronger because the resulting multitude of joints from single panels add weak points to the roof.

Figure 2:
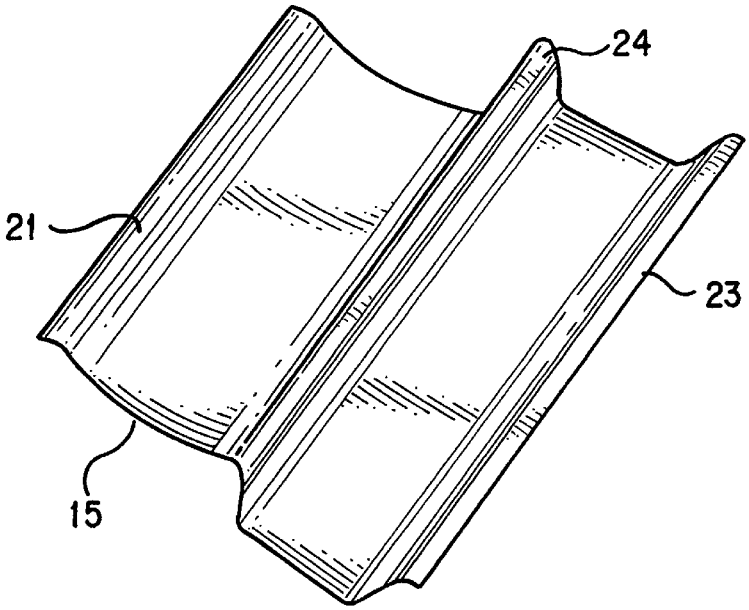
FIG. 2 is a perspective view of a panel used in FIG. 1.

FIG. 2 is a perspective view of the second roof panel of FIG. 1 where like reference numerals refer to like elements. End 21 has a length shorter than portion 24 or end 23. Portion 22 is lower or deeper than portion 15 in order to provide the appropriate space for air flow as noted above. Where there is only a single panel, such as the first and Nth panels of FIG. 1, then such panel would have a length corresponding to the length of either 15 or 22. If it is an end panel such as 11–13 of FIG. 1 then it has a longer length such as 22. If it is a shorter panel such as N1–N3 of FIG. 1 it will have a shorter length such as 15.

The upper portions of the panels, such as 15, 25, 35 and 45 of FIG. 1 and 15 of FIG. 2 can be considered sun shields for the roof, while the lower portions, 12, 22, 32 and 42 are considered water roofs and serve to convey accumulated moisture, or condensate, and rain water. That is to say, the sun shield portion of a panel serves to keep the lower portion of the water roof cool. On particularly warm days there is a flow of air that in turn cools the sun panel portion too. This dual effect, the sun shield keeping the lower portion cooler, and the flow of air, in turn, helping to keep the sun shield cooler, serves to keep cooling costs lower, particularly in hot, sunny areas.

Figure 3:
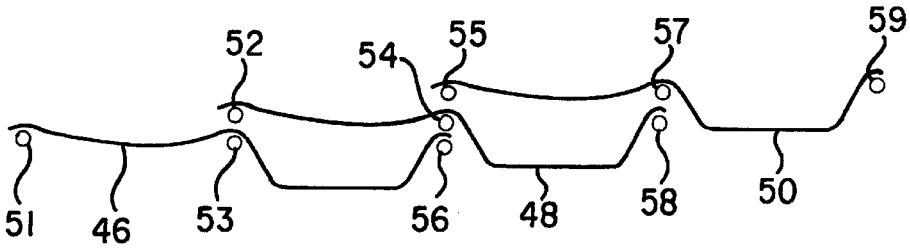
FIG. 3 is a view similar to FIG. 1 using spacers.

FIG. 3 is another side view of the inventive panels having spacing means. Three panels 46, 48, 50 are shown with optional spacers 51–59. These spacers may be used if desired depending on environmental and other factors. They may be made of a bituminous material, for example, bitumen, and adhere to the panels by heating. This application may be made at the factory or at any other point prior to roof assembly. The spacers may be about an inch wide and may extend the length of the panel. These spacers serve an important function in that they lessen the tendency of the panels from movement due to temperature changes which would cause movement in the absence of spacers. The spacers serve to generally inhibit the movement of panels and limit the noise associated with panel movement, which are common problems with some roofs.

Figure 4:
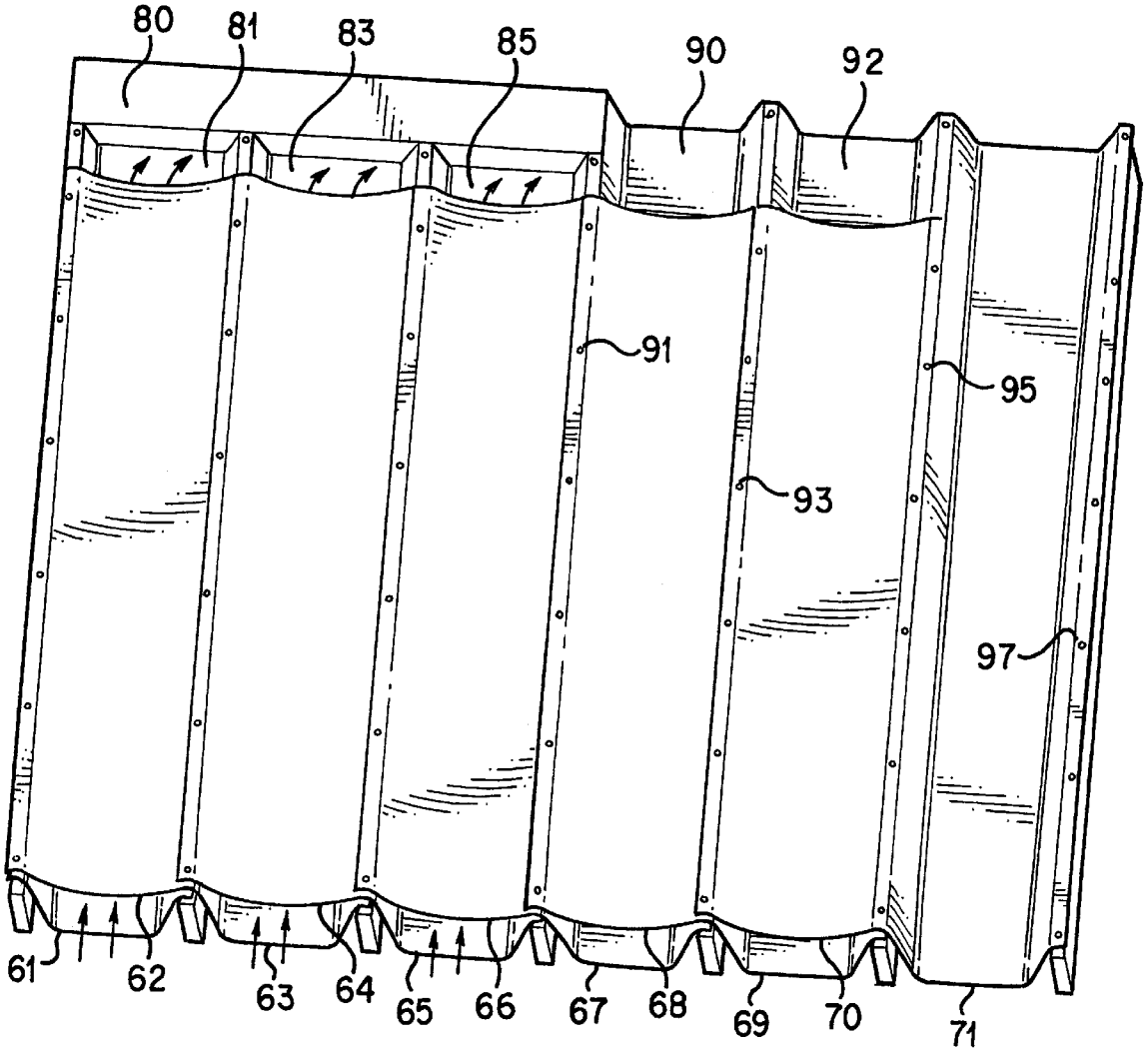
FIG. 4 is a perspective view of a roof assembly

FIG. 4 is a perspective view of a portion of a roof assembly. There are six panels numbered 61, 62–63, 64–65, 66–67, 68–69 and 70–71. The even numbers 62, 64, 66, 68 and 70 are the upper portions of the panels and are termed sun shields. The odd numbered parts of the panels, 63, 65, 67, 69 and 71 are the lower portions of the panels are are termed water roofs. A single panel 61, at the beginning of the series of panels, is a water roof. For illustrative purposes a final sun shield that would overlay water roof 71 is not shown.

The air flow is shown by the arrows entering between 61/62, 63/64, 65/66 and exiting to the ambient at the top at openings 81, 83, 85. The apex of the roof has a shield member 80 which extends the length of the apex but is shown in partial length in FIG. 4. In the prior art with no openings to the ambient shields at the apex act to prevent rain from flowing downwardly and serve as barriers to air flow. In sharp contrast the inventive roof provides openings at 81, 83 and 85 so that the lower panels, that is, the water roofs, are exposed to the ambient specifically to permit rain to flow and to permit the free flow of air. As clearly seen at 90, 92 and 71 the water roofs extend from the top to the bottom of the roof while the sun shields extend partially from top to bottom as shown at 62, 64, 66, 68 and 70. The first and last panels would be single panels such as 61 in FIG. 4 or 11–13 and N1, N2 in FIG. 1. The other panels are made of two portions, a sun shield such as 62 and a water roof such as 63.

The upper portions may be nailed or otherwise fastened directly from above into the joists as shown at 91, 93, 95 and 97. Those parts of the panels that are juxtaposed to the joists may advantageously be nailed or fastened from the sides where they are close to the joists.

In the prior art, lacking a sun shield or with a single roof or having an unexposed panel, on a cool, clear night with no cloud cover, condensation occurs resulting in the formation of water or ice or both. This causes water drops on the rafters or mildew to form in the interior of the home. With a sun shield according to the present invention instead of accumulated moisture on the underside of the upper roof panel, condensate drops and falls on the water roof and flows harmlessly down to the lower part and off the roof. The effect is particularly significant on cool or cold nights. The roof is open at the apex permitting air to exit instead of meeting some barrier as is common in the prior art.

Prior art roofs that did have a lower panel or the like were never intended to carry water as that function was given over to the upper roof panel or tile panel. In effect they have no water roof or its equivalent. With the present invention the lower panel, or water roof, is intended to carry water that may result from condensation of the upper roof or sun shield as well as rain water.

In some prior art tile roofs the tiles warm up because barriers interfere with the movement of air in contrast to the present invention where a sun shield acts to reduce warming of the water roof as there is no impediment to the flow of air.

Another advantage of the present invention is the fact that the water roof may be nailed or fastened from its sides as well as the top. Because roofs commonly lie over rafters they often cannot be fastened from the sides. With the teachings of the invention fastening from the sides is possible with the advantage that the lower panel, the water roof, is additionally strengthened against forces such as upward wind lift. This advantage against wind lift also arises from the fact that there are lower panels between joists instead of just on the joists. At every joist there are at least two separate panels beneath the fastening means that are driven from the top of the uppermost panel.

A further option, not shown, is the addition of another roof such as a steel or ceramic tile roof on top of the inventive roof.

In summary any moisture which may accumulate on roofs of the prior art can cause problems on the roof proper and below it. With the teachings of the present invention any accumulated moisture on the lower panels as well as rain water will flow down the spaces.

The invention has particular utility in northern climates where condensation can be a problem. In southern climates the main problem is heat and the need to cool the dwelling is of primary importance.

I claim:

1. A roof comprising:

a series of joists succeeding one another;

a series of roof panels, including at least a first, second, and third roof panel;

said first roof panel with first and second ends extends from said first end and a first joist to said second end and a second joist, said first and second joists being succeeding joists, said first roof panel having an intermediate portion lower than said first and second ends;

said second roof panel extends from said first joist to said third joist and having upper and lower portions, said upper portion of said second roof panel overlays said first panel and extending from said first to said second joists, said lower portion of said second roof panel extending from said second to said third joists, said third roof panel extends from said second joist to a third joist, whereby said third roof panel overlays said lower portion of said second roof panel, and said lower portions of said roof panels being longer than said upper portions, whereby openings are provided at the top of the roof to expose said lower portions to the ambient.

2. The roof of claim 1 further comprising a plurality of additional roof panels between said second and third roof panels, each of said additional roof panels having upper and lower portions.

3. A roof comprising:

a series of roof panels, including at least a first, second, and third roof panels;

said first roof panel being a lower panel;

said second roof panels having an upper portion and a lower portion, an upper portion of said second panel overlays said lower panel, and said third roof panel being an upper panel, said third panel overlays said lower portion of said second roof panel, and said lower portions of said roof panels being longer than said upper portions, whereby openings are provided at the top of the roof to expose said lower portions to the ambient.

4. The roof of claim 3 further comprising a plurality of additional roof panels between said first and third panels, each of said additional roof panels having upper and lower portions.

5. A roof comprising:

a series of roof panels, including at least a first roof panel, a plurality of additional roof panels, and an Nth roof panel;

said first roof panel being a lower panel;

said plurality of additional roof panels each having an upper portion and a lower portion, an upper portion of one of said additional roof panels overlays said lower panel, said Nth roof panels being an upper panel, said Nth panel overlays one of said lower portions of one of said additional roof panels, and said lower portions of said roof panels being longer than said upper portions and said upper panels, whereby openings are provided at the top of the roof to expose said lower portions to the ambient.

* * * * *